United States Patent [19]

Iwamoto et al.

[11] Patent Number: 4,782,360

[45] Date of Patent: Nov. 1, 1988

[54] ROTARY TYPE DEVELOPING APPARATUS

[75] Inventors: Ken-ichi Iwamoto, Nara; Kouichi Matsumoto, Gojo; Hiroshi Kida, Yamatokoriyama; Tatsuya Inoue, Yamatokoriyama; Shoichiro Yoshiura, Yamatokoriyama, all of Japan

[73] Assignee: Sharp Kabushiki Kaisha, Osaka, Japan

[21] Appl. No.: 2,201

[22] Filed: Jan. 12, 1987

[30] Foreign Application Priority Data

Jan. 13, 1986 [JP] Japan ..... 61-5523
Jan. 13, 1986 [JP] Japan ..... 61-5525
Jan. 13, 1986 [JP] Japan ..... 61-5526
Jan. 13, 1986 [JP] Japan ..... 61-3194[U]

[51] Int. Cl.[4] ..... G03G 15/01; G03G 15/08

[52] U.S. Cl. ..... 355/4; 355/3 DD; 118/645

[58] Field of Search ..... 355/4, 3 DD, 14 D; 118/645

[56] References Cited

U.S. PATENT DOCUMENTS 3,128,743 4/1964 Whiting .
3,987,756 10/1976 Katayama et al. ..... 118/645
4,011,759 3/1977 Phillips et al. .
4,014,284 3/1977 Read .
4,029,042 6/1977 Juhasz .
4,130,745 12/1978 Hetzer .
4,172,971 10/1979 Silverwater et al. .
4,203,284 5/1980 Silverwater .
4,266,517 5/1981 Sakakibara et al. .
4,426,952 1/1984 Crisp, Jr. .
4,498,495 2/1985 Worwood et al. .
4,622,916 11/1986 Tanaka et al. ..... 355/4 X
4,645,887 2/1987 Whiting .
4,646,679 3/1987 Ohno et al. ..... 118/645 X
4,652,113 3/1987 Watanabe ..... 355/4 X

FOREIGN PATENT DOCUMENTS 0123869 7/1985 Japan ..... 355/4
0233669 11/1985 Japan ..... 355/4
0230170 11/1985 Japan ..... 355/4

*Primary Examiner*—R. L. Moses
*Attorney, Agent, or Firm*—Birch, Stewart, Kolasch & Birch

[57] ABSTRACT

A rotary type developing apparatus for use in an image forming arrangement, which is so arranged that, by restricting rotational angle of each of a plurality of developer units (A, B), mixing of developing materials in a receiving pan (27) is prevented, and even if some mixing should take place, mixture of a colored developer material with a non-colored developing material may be advantageously reduced.

3 Claims, 5 Drawing Sheets

ROTARY TYPE DEVELOPING APPARATUS

BACKGROUND OF THE INVENTION

The present invention generally relates to electrophotography and more particularly, to a rotary type developing apparatus provided with a plurality of developing units for use in an image forming arrangement such as an electrophotographic copying machine and the like.

Commonly, for producing a plurality of single-colored copies each in a different color, it is necessary to replace developing tanks for each color. In a typical image forming arrangement, a plurality of developing tanks are arranged in which developing materials of different colors are respectively accommodated so as to replace one developing tank with another to be actually used by opening a front panel of the image forming arrangement. In the above construction, however, since the number of developing tanks mounted in the main body of the arrangement is limited to only one, there is the disadvantage that the developing tank must inevitably be exchanged for that for changing the color of the copy.

Accordingly, there has conventionally been proposed in Japanese Patent Publication Tokkosho No. 55-3707, a developing apparatus in which a plurality of developing tanks are disposed around a photoreceptor drum so as to make it possible to use any desired developing tank depending on the necessity.

In the above known arrangement, however, a large space is occupied around the photoreceptor drum by the developing tanks, thus adversely affecting other image forming processing members. Furthermore, since the distance from an exposure position to a developing position differs for each developing tank, there is the possibility that tone of color, image contrast, etc. become different according to each developing tank. Moreover, owing to the fact that the angle for development of the developing tank with respect to the surface of the photoreceptor drum is also different for each tank, thus making it necessary to change the shape of the developing tank accordingly, there is also the disadvantage that the manufacturing cost of the developing tanks is increased on the whole.

Japanese Patent Publication Tokkosho No. 46-13478 discloses an image forming arrangement in which a plurality of developing tanks are rotatably supported on the same shaft. In this arrangement, however, a complicated driving mechanism is required since the respective developing tanks are directed in the same direction at all times, with a consequent increase in the size of the arrangement.

Meanwhile, in Japanese Patent Publication Tokkosho No. 55-20579, there has conventionally been proposed a rotary type developing apparatus in which a plurality of developing tanks are rotatably supported for selectively causing one of the tanks to confront the photoreceptor drum. In the rotary type developing appartaus of the above described type, although the defects in the developing apparatus as disclosed in the above Japanese Patent Publications Tokkosho Nos. 55-3707 and 46-13478 may be eliminated, it is necessary to preliminarily set the developing tanks corresponding to the number of developing colors if such developing colors are to be increased in number, and thus, the size of the developing apparatus is undesirably increased on the whole as the number of colors to be used for the development is increased.

In order to overcome the disadvantages as described so far, the present inventors have previously proposed, in Japanese Patent Application Tokugansho No. 60-270314 assigned to the same assignee as in the present invention, a developing unit exchange device for a rotary type developing apparatus in which two developing units are rotatably supported for selectively causing one of the developing units to confront the photoreceptor drum, with each of a plurality of the developing units being arranged to be exchangeable.

However, in the known device as described above, if the two developing units are adapted to be rotatable regardless of respective rotating directions thereof, developing materials scattering from opening portions of the respective developing units are undesirably mixed with each other in a receiving pan, and thus, such mixed developer materials are further mixed with the developer material within the developing unit when the developing unit is being rotated. In the above case, if a non-colored developer material such as a black developer material excluding a white group developer material is mixed with the colored developer material, there arises the problem that the image quality during the development is remarkably deteriorated.

SUMMARY OF THE INVENTION

Accordingly, an essential object of the present invention is to provide a rotary type developing apparatus for use in an image forming structure, which is so arranged that, by restricting rotational range of each of a plurality of developer units, mixing of developing materials in a receiving pan is prevented, and even if some mixing should take place, mixture of a colored developing material with a non-colored developing material may at least be advantageously reduced.

In accomplishing this object, according to one preferred embodiment of the present invention, there is provided a rotary type developing apparatus for use in an image forming arrangement, which includes a first developing unit accommodating therein a colored developer material, and a second developing unit accommodating therein a non-colored developer material, excluding a white group developer material, with the first and second developing units being respectively exchangeably disposed beside a photoreceptor drum, and rotatably supported so as to selectively cause one of the developing units to confront the photoreceptor drum, and a receiving pan provided below the developing units for receiving the developer material scattering therefrom, the apparatus characterized in that there are further provided a rotation restricting means for restricting the rotational range of the first developing unit to an upper half, and that of the second developing unit to a lower half, and a mounting position limiting means for enabling the first developing unit to be mounted only at the upper side of a main body of the developing apparatus.

By the above arrangement according to the present invention since the first developing unit accommodating the colored developer material is rotatable only in the range for the upper half, the receiving pan is almost free from the presence or adhesion of the colored developer material scattering from the first developing unit. Moreover, owing to the arrangement that only the first developing unit can be mounted at the upper side of the developing apparatus main body, the colored developer material which may adhere to the receiving pan is limited to a small amount. Accordingly, in the case where the developing unit for the non-colored developer material is mounted at the lower side of the developing apparatus main body, only a small amount of the colored developer material is mixed in a larger amount of the non-colored developer material. Therefore, even if the mixture of such developer materials in the receiving pan should enter the second developing unit, the image quality is hardly adversely affected thereby.

Another important object of the present invention is to provide a rotary type developing apparatus of the above described type, in which color marks are affixed onto the respective developing units so as to be visbile from the outside, whereby an operator can readily be assured that the developing unit is in a usable state at that time, together with the color of the developer material contained therein.

In accomplishing the above object, the present invention provides a rotary type developing apparatus for use in an image forming arrangement, which includes a plurality of developing units disposed beside a photoreceptor drum, and rotatably supported so as to selectively cause one of the developing units to confront the photoreceptor drum, with the respective developing units being mounted to be exchangeable, color marks affixed on a surface of a casing of each of the developing units for indicating color of the developing material accommodated in each of the developing units, and light transmitting portions provided on a main body of the image forming arrangement in positions confronting the color marks affixed on the developing units.

By the above construction of the present invention, it becomes possible for the operator to immediately find the color of the developer material of the developing unit in a usable state confronting the photoreceptor drum and the color of the developer material of the other developing unit set as a spare unit by merely observing the light transmitting portions of the image forming arrangement main body without the necessity for opening part of the main body or drawing out the rotary type developing apparatus from the main body. Therefore, in the case where the developer unit for the developing material of the color necessary for the development is not attached, the desired developing unit may be readily mounted before entering the image forming process, while, when a developing unit for the developing material of the color not required for the development is mounted, it is possible to preliminarily replace such developing unit with another one. In other words, it is possible to have the developing unit for the developer material of a necessary color to be mounted at all times on the developing apparatus without impairing the operability for the operator.

A further object of the present invention is to provide a rotary type developing apparatus of the above described type, which is so arranged that a stopper member functions during the exchanging of the developing units so that a new developing unit may be smoothly attached without any danger during replacement of the developing units.

According to the present invention, the above object is achieved by providing a rotary type developing apparatus for use in an image forming arrangement, which includes a plurality of developing units disposed beside a photoreceptor drum, and rotatably supported so as to selectively cause one of the developing units to confront the photoreceptor drum, with the remaining respective developing units being mounted to be exchangeable, and a stopper member provided to prevent rotation of a main body of the developing apparatus when either one of the plurality of the developing units is to be exchanged.

By the above construction, when either one of the developing units is to be exchanged, the other developing unit is prevented from rotation by the action of the stopper, and thus, inconveniences such as injury to operators, difficulties for attaching a new developing unit, etc. may be eliminated.

Still another object of the present invention is to provide a developing unit exchanging device for a rotary type developing apparatus, which is so arranged that, with a plurality of developing units being supported by the rotary type developing apparatus, a specific developing unit is adapted to be readily replaced upon opening of an open/close plate provided in a housing of the image forming arrangement, and thus, the developing apparatus as a whole is not increased in its size even when the colors of usable developer materials are increased in number, with a superior workability during exchanging owing to the arrangement that the open/close plate is located at the upper portion of the image forming arrangement.

In order to accomplish the above object, according to the present invention, there is provided a developing unit exchanging device for a rotary type developing apparatus for use in an image forming arrangement, which includes a plurality of developing units disposed beside a photoreceptor drum, and rotatably supported so as to selectively cause one of the developing units to confront the photoreceptor drum, connectable roller driving portions and engaging portions provided beside the developing units, an open/close plate provided in a position immediately above the rotary type developing apparatus in a housing of the image forming arrangement accommodating the developing apparatus, a connecting plate connectable with the roller driving portions of the developing unit located at the side of the photoreceptor drum of the plurality of the developing units, and movable in the axial direction of the developing unit, a developing unit positioning means movable in the direction of the photoreceptor drum and adapted to effect positioning of the developing unit during the movement in the direction of the photoreceptor drum, engaging receiving portions engageable with the engaging portions of the plurality of the developing units upon positioning by the developing unit positioning means, and a link mechanism which connects the open/close plate, connecting plate and developing unit positioning means, so arranged to move the connecting plate in the direction for connection with the roller driving portions to bring them into a connected state upon closure of the open/close plate and also, to displace the developing unit positioning means in the direction of the photoreceptor drum for positioning of the developing unit, and further, to set the developing unit in a detachable state by releasing the connected state and the positioned state upon opening of the open/close plate.

By the construction according to the present invention as described above, when the open/close plate is opened, the connected state of the roller driving portions and the state of positioning are released for setting the developing units so as to be detachable. Meanwhile, upon closure of the open/close plate, the connected state and the positioned state, as referred to above are established, and the developing unit is attached in the positioned state. Accordingly, in this construction, the developing units may be set in the detachable state or in the positioned mounted state with respect to the developing apparatus by merely opening or closing the open/close plate. Therefore, if a plurality of developing units containing the developing materials of comparatively widely used colors are properly selected to be mounted on the developing apparatus, any desired developing color may be used from these colors by merely rotating the developing units during the normal period, while when the development by another color becomes necessary, if the developing unit is exchanged by opening the open/cose plate, the developing may be effected by such exchanged color. Even in this case, the exchange of the developing units is readily effected by opening or closing the open/close plate through a very simple procedure. Moreover, since the open/close plate is located immediately above the rotary type developing apparatus, workability during the exchange is very superior.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
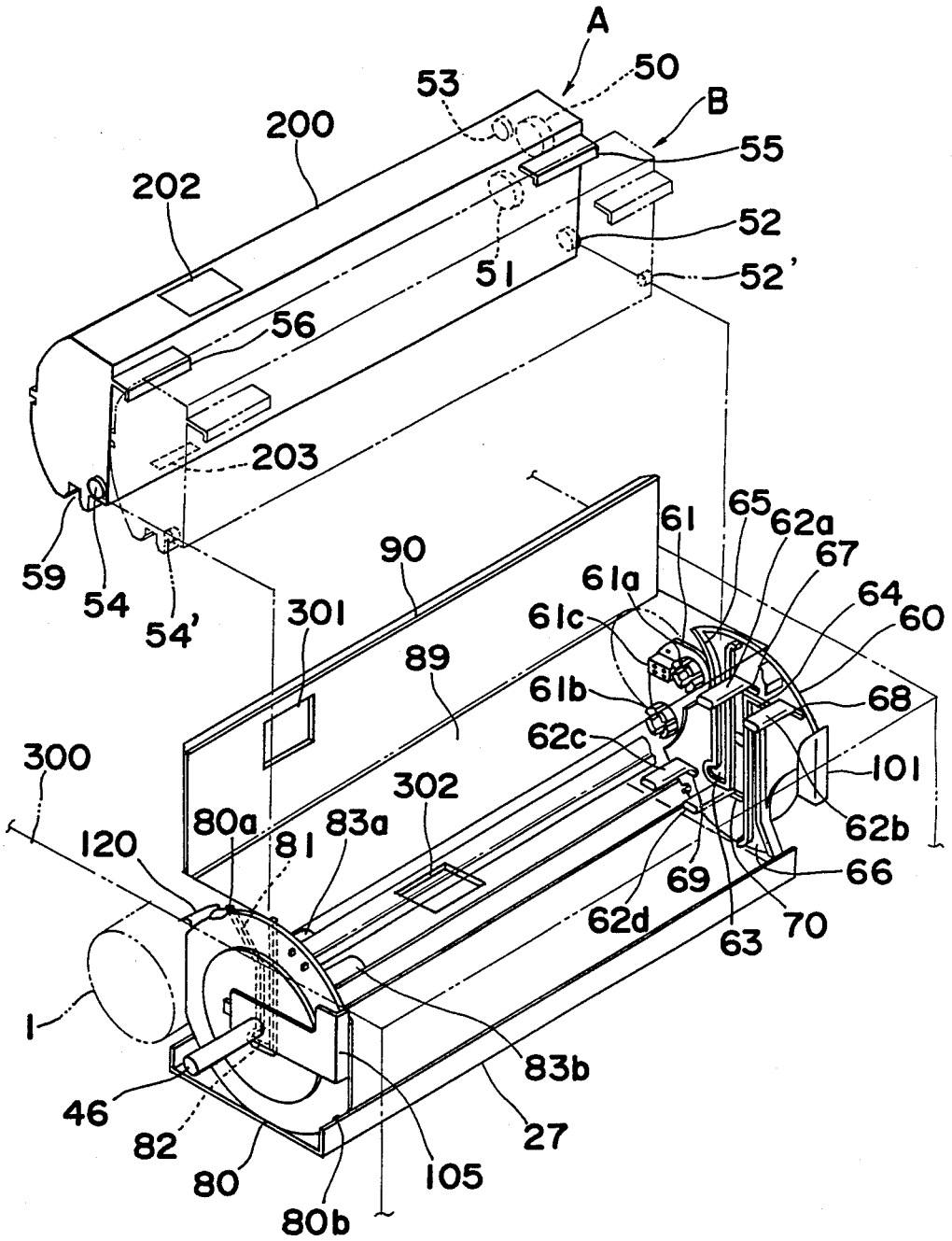
FIG. 1 is an exploded perspective view of a developing unit exchanging device for a rotary type developing apparatus according to one preferred embodiment of the present invention.

Before the description of the present invention proceeds, it is to be noted that like parts are designated by like reference numerals throughout the accompanying drawings.

Referring now to the drawings, the present invention will be described in detail hereinbelow with respect to one preferred embodiment thereof.

(a) Construction at essential portion of copying machine

Figure 2:
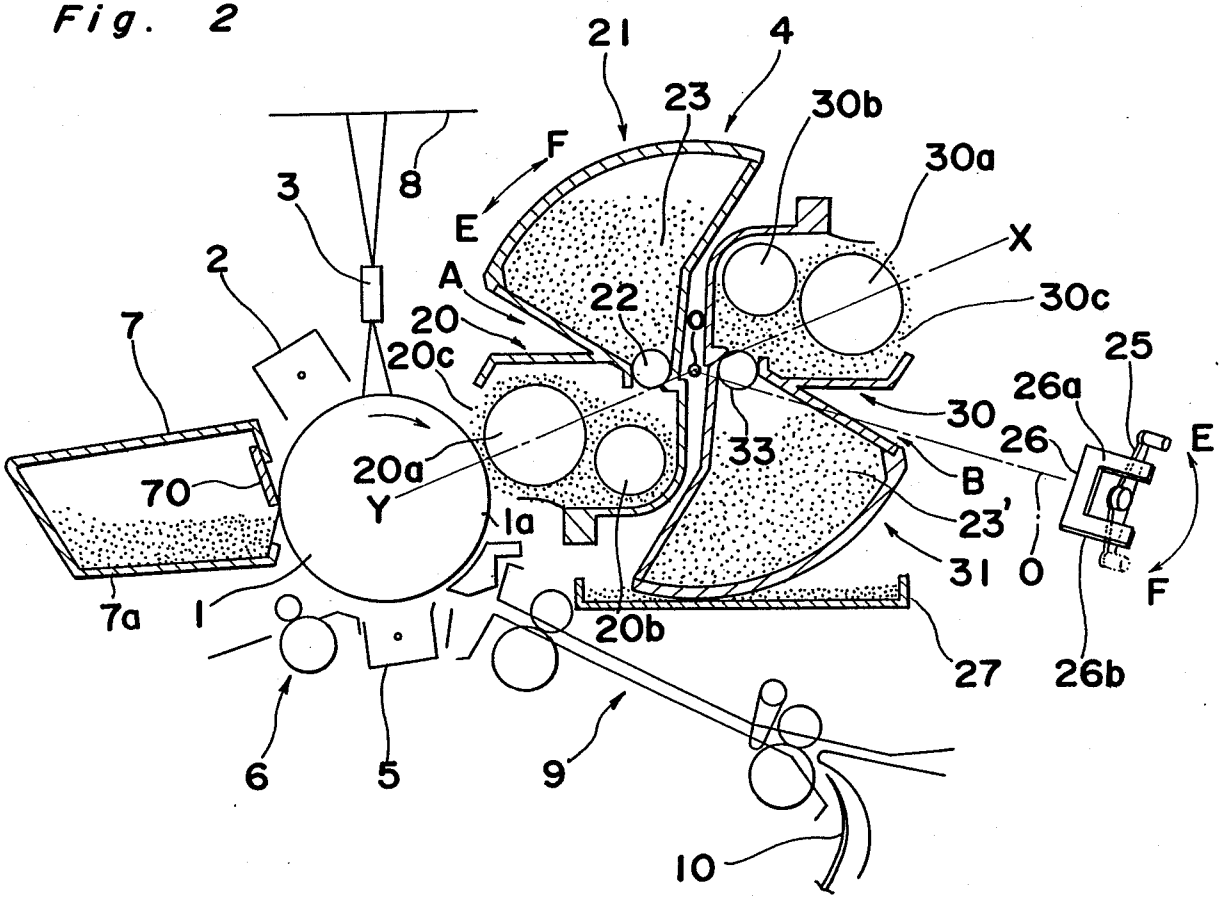
FIG. 2 is a schematic side sectional view showing an essential portion of a copying apparatus employing the arrangement of FIG. 1.

Referring first to FIG. 2, there is shown an essential portion of an electrophotographic copying machine which employs a developing unit exchanging device for a rotary type developing apparatus according to one preferred embodiment of the present invention. In FIG. 2, the copying machine generally includes a photoreceptor drum 1 having a photosensitive surface 1*a* on its peripheral portion rotatably provided at the left side of the copying machine for rotation in the direction indicated by an arrow, and a series of processing stations such as a first corona charger 2, an image transmitter 3 in a bundled configuration, the rotary type developing apparatus 4, a transfer charger 5, separating rollers 6, and a cleaner unit 7, etc. sequentially disposed in that order around the photoreceptor drum 1. The first corona charge 2 is intended to uniformly charge the photosensitive surface 1*a* of the photoreceptor drum 1 preliminarily, and the image transmitter 3 is to form an image of an original document 8 onto the photorsensitive surface 1*a* of the photoreceptor drum 1. Copy paper sheets 10 are transported from a paper feeding cassette (not shown) to the transfer portion at the transfer charger 5, one sheet by one sheet, through a transport passage 9. The cleaner unit 7 includes a used toner box 7*a* and a blade 70 provided at one open edge of the toner box 7*a* for contact, at its forward edge, with the photosensitive surface 1*a* so as to scrape off used toner therefrom for accommodation into the toner box 7*a*.

The rotary type developing apparatus 4 referred to above includes two developing units A and B. The first developing unit A accommodates a colored developing material therein, while the second developing unit B contains a black (or non-colored) developing material therein. These developing units A and B can be rotated either in a clockwise direction (i.e, direction of an arrow F) or in a counterclockwise direction (i.e., direction of an arrow E) about a rotary shaft 0. Since a rotating lever 25 is fixed at the forward end of the rotary shaft 0, the developing units A and B may be rotated by operating said rotating lever 25. However, the rotating lever 25 is restricted in its rotating range by a stopper 26. More specifically, the developing units A and B are respectively restricted in the rotational range for an upper half, and a lower half about a line X-Y. When the rotating lever 25 is fully rotated in the direction of the arrow E so as to contact one stopper piece 26*a* of the stopper 26 (solid line position in FIG. 2), the positional relation is such that a developing roller 20*a* of the developing unit A confronts the photoreceptor drum 1. Meanwhile, when the rotating lever 25 is fully rotated in the direction of the arrow F so as to contact the other stopper piece 26*b* (two-dotted line position in FIG. 2), the relation becomes such that a developing roller 30*a* of the developing unit B confronts the photoreceptor drum 1. The stopper 26 corresponds to the rotation restricting means according to the present invention.

The developing unit A includes a developing tank 20 open at one side 20*c* and having the developing roller 20*a* and a stirring roller 20*b* rotatably provided therein, and a hopper 21 accommodating a developing material 23 therein and integrally connected with the developing tank 20, while a toner replenishing roller 22 is rotatably provided in a passage between the developing tank 20 and the hopper 21. The hopper 21 is intended to supply the developing material into the developing tank 20 through the roller 22 when the developing material 23 within the tank 20 is reduced. The developing unit B has the construction similar to that of the developing unit A, and includes a developing tank 30 open at one side 30*c*, with the developing roller 30*a* and a stirring roller 30*b* rotatably provided therein, a hopper 31 integrally connected to the developing tank 30, and a toner replenishing roller 33 rotatably provided between the hopper 31 and the developing tank 30. The developing unit B is provided in a relation of point symmetry with respect to the developing unit A about the rotary shaft 0.

Below the rotary type developing apparatus 4 as described above, there is provided a receiving pan 27 for receiving the developing material scattering from the developing units A and B. The receiving pan 27 is disposed in such a position that, when the developing unit B is rotated, with its developing roller 30*a* directed downward, magnetic brush bristles of the developing material formed on the surface of the roller 30*a* contacts the developing material adhering to the interior of the receiving pan 27.

(b) Construction of developing unit exchanging device (i) Construction in the vicinity of rotation support plate Referring now to FIG. 1, there is seen the construction of a developing unit exchanging device for the rotary type developing apparatus as described so far.

The developing unit A containing the colored developing material is provided, at its right side in Fig. 1, with connectable roller driving portions 50 and 51, and an engaging projection 52 constituting an engaging portion. The developing unit A is also provided, at its left side wall, with another engaging projection 54 in a position symmetrical with respect to the engaging projection 52. Although the developing unit B containing the non-colored developing material has the construction generally similar to that of the developing unit A, sizes of engaging projections 52' and 54' thereof are set to be smaller than the engaging projections 52 and 54. Moreover, in the present embodiment, there is provided a connector 53, for effecting electrical connection, besides the roller driving portions 50 and 51, and the engaging projection 52. Furthermore, on the upper portions at opposite ends of the rear face of the developing unit A, arm engaging projections 55 and 56 which engage arms for positioning, to be described later, are provided. The developing unit A is further formed, in its bottom wall, with an arm engaging groove 59 for engagement with the positioning arm. The roller driving portion 51 is connected with a roatry shaft (not shown) of the developing roller 20*a*, while a roller driving portion 50 is connected to a rotary shaft (not shown) of the stirring roller 20*b*. These roller driving portions 50 and 51 are connected to a connecting device to be described later so as to receive a driving force from the copying machine main body. It is to be noted that the developing unit B is also provided with the roller driving portions and connector, etc. as shown in two-dotted chain lines in FIG. 1.

In the housing of the copying machine main body, there are provided support portions for the rotary type developing apparatus, which support the developing units A and B at the opposite sides thereof in a manner as described hereinbelow.

The support portion at the right side in FIG. 1 includes a clockwise rotation support plate 60 cut out at its opposite sides, and a connecting plate 61 located at the cut-out portion of the support plate 60 at the side of the photoreceptor drum 1. The connecting plate 61 is displaceable in the axial direction of the developing unit, and provided, in its inner side, with connecting portions 61*a* and 61*b* engageable with the roller driving portions 50 and 51 of the developing unit A, and also, with a connector receiver 61*c* engageable with the connector 53.

At the inner side of the clockwise rotation support plate 60, there are provided a guide groove 65 open at its upper portion and vertically extending downwardly, and another guide groove 66 open at its lower portion and vertically extending upwardly in the similar manner as in the guide groove 65. The guide groove 66 has a width smaller than that of the guide groove 65, and the guide groove 65 receives the engaging projection 52 of the developing unit A, while the guide groove 66 is engaged with the engaging projection 52' of the developing unit B.

Owing to the arrangement that the guide grooves 65 and 66 have different widths and the projection 52 is large in size as compared with the projection 52', the engaging projection 52 is not fitted into the guide groove 66.

Mounting of the developing unit B is effected after having directed the opening of the guide groove 66 upwardly by the mechanism to be described later. The developing unit attached along the guide groove 65 is rotated at the upper side of the line X-Y in FIG. 2, while the developing unit mounted along the guide groove 66 is rotated at the lower side of the line X-Y.

The guide groove 65 is formed, at its lower end portion, with a slightly wider groove portion which serves as an engaging receiving portion 63 with which the engaging projection 52 of the developing unit A is to be engaged. Meanwhile, the guide groove 66 is also formed, at its upper end portion, with a wider groove portion which serves as an engaging receiving portion 64 to be engaged with the engaging projection 52' of the developing unit B. The clockwise rotation support plate 60 is further formed, at its upper portion, with elongated openings 67 and 68, and at its lower portion, with elongated openings 69 and 70. Into these elongated openings 67 and 68, positioning arms 62*a* and 62*b*, to be described later are inserted in the axial direction of the developing unit, from the outer side of the clockwise rotation support plate 60. Similarly, positioning arms 62*c* and 62*d* are inserted through the elongated openings 69 and 70 in the direction of the axis of the developing unit. As described later, these positioning arms 62*a* to 62*d* are displaceable in the direction of the photoreceptor drum 1 along the elongated openings 67 to 70. When the positioning arms 62*a* to 62*d* are displaced in the direction of the photoreceptor drum 1 in the state where the developing units A and B are mounted, the engaging projections provided on the developing units engage the engaging receiving portions formed at the upper and lower portions of the guide grooves, thereby to effect the positioning of the developing units.

Meanwhile, at the position facing the clockwise rotation support plate 60, and spaced therefrom by a length of the developing unit, a counterclockwise rotation support plate 80 is provided for supporting the left side wall of the developing unit. At the inner side of this counterclockwise rotation support plate 80 also, a guide groove 81 of the same size as the guide groove 65 of the clockwise rotating support plate 60 is provided at the similar position, with another guide groove (not shown) being further formed at the similar position as that of the guide groove 66 of the support plate 60 described earlier. At the lower end portion of this guide groove 81, an engaging receiving portion 82 is formed so as to receive the engaging projection 54 of the developing unit A. Moreover, at positions confronting the positioning arms 62*a* and 62*b*, positioning arms 83*a* and 83*b* are provided for displacement in the direction of the photoreceptor drum 1, while at the lower portion also, positioning arms 83*c* and 83*d* (not shown) are provided to confront the positioning arms 62*c* and 62*d*.

Figure 7:
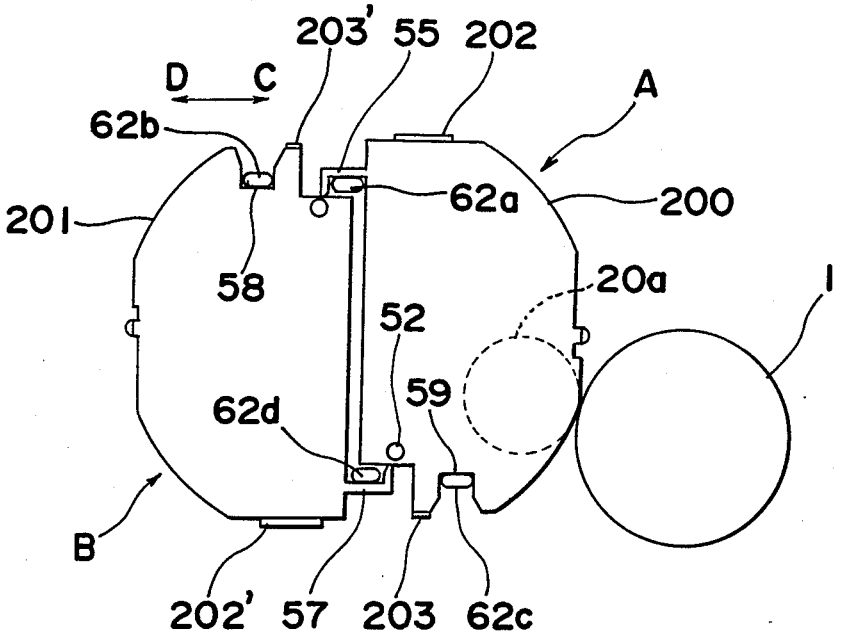
FIG. 7 is a diagram showing a positional relation between positioning arms and the developing unit.

FIG. 7 shows the state where the developing units A and B are mounted, and the positioning arms 62*a* to 62*d* are engaged with the arm engaging projections and arm engaging grooves (FIG. 1) of the developing unit. In FIG. 7, the arm engaging projection and arm engaging groove for the developing unit A are indicated by the numerals 55 and 59, while those for the developing unit B are represented by the numerals 57 and 58.

(ii) Construction of open/close plate

Figure 3:
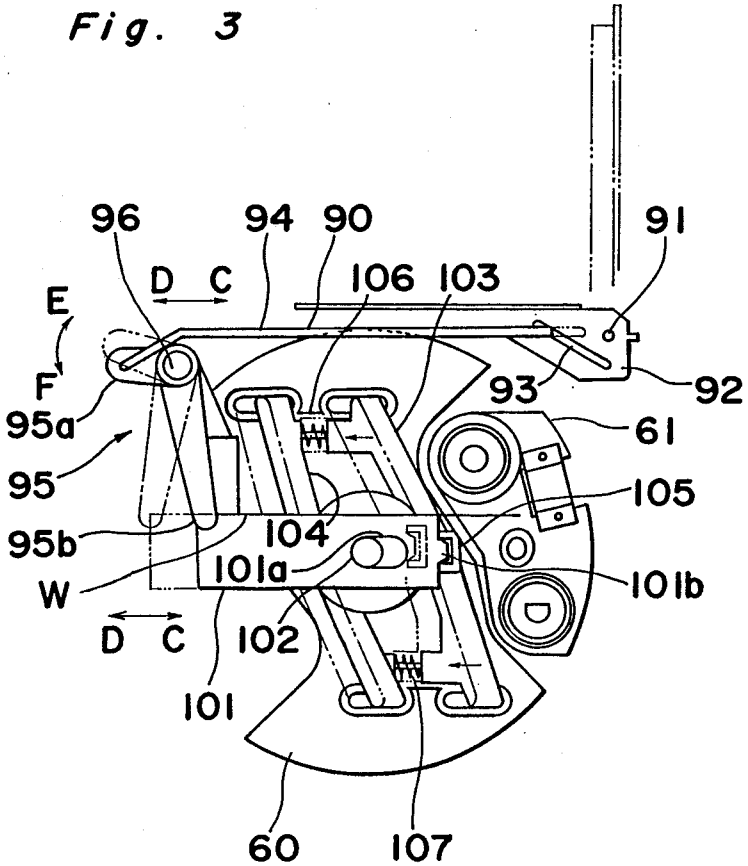
FIG. 3 is a rear side view of a clockwise rotation support plate employed in the arrangement of FIG. 1.

In the housing wall above the rotation support plate 60 and 80, i.e., above the developing apparatus including the developing units, there is pivotally provided an open/close plate 90 (FIGS. 1 and 3). The size of an opening portion 89 to be formed upon turning upwardly or opening of the open/close plate 90 is so set as to just allow one developing unit to pass therethrough. Moreover, as described later, by a link mechanism connected to this open/close plate 90, the positioning arms 62 (62*a* to 62*d*) and 83 (83*a* to 83*d*) are displaced in the direction of the photoreceptor drum 1 according to the open/close functions of the plate 90, with the connecting plate 61 moving in the axial direction of the developing unit. Upon opening of the open/close plate 90, the positioning arms 62 and 83 are displaced in the direction opposite to the photoreceptor drum 1, while the connecting plate 61 is moved in the direction to release the connected state. By the movement of the connecting plate 61 in the connection releasing direction, with the displacement of the positioning arms 62 and 83 in the direction opposite to the photoreceptor drum 1, the engagement betwen the engaging projections 52 and 54 of the developing unit A located at the side of the photoreceptor drum 1, and the engaging receiving portions 63 and 82 provided at the lower end of the portions of the guide grooves 65 and 81 located at the side of the photoreceptor drum 1, is released, and the developing unit A is brought into the state where it can be shifted upwardly along the guide grooves 65 and 81. In other words, it becomes possible to take out the developing unit A from the developing apparatus through the opening portion 89 formed by opening the open/close plate 90. It is to be noted here that, in the above case, since the developing unit B is also brought into the state where it may fall downwardly, such a filling is prevented by providing a support plate (not shown).

Moreover, around the peripheral portion of the counterclockwise rotation support plate 80, two cut-out portions or notches 80*a* and 80*b* are symmetrically formed, while a rotation restricting elastic member 120 engageable with the cut-out portions 80*a* and 80*b* is provided in the housing of the copying machine main body. During rotation of the counterclockwise rotation support plate 80, the elastic member 120 slides along the peripheral edge of the support plate 80 except for the cut-out portions 80*a* and 80*b*. Upon engagement of the rotation restricting member 120 with the cut-out portion 80*a*, the opened portion of the guide groove 65 is directed upward, and the developing unit A is in a position where it is replaceable through the open/close plate 90. Simultaneously, at this position, the developing roller 20*a* of the developing unit A confronts the photoreceptor drum 1 so as to make it possible to effect the development. Upon engagement of the rotation restricting elastic member 120 with the cut-out portion 80*b*, the opened portion of the guide groove 66 is directed upward, at which position, it becomes possible to replace the developing unit B through the open/close plate 90, with the developing roller 30*a* of the unit B facing the photoreceptor drum 1 for allowing the development to be effected.

(iii) Display device for colors of developing materials

As shown in FIG. 1, a color mark 202 is formed on the upper surface of a case 200 for the developing unit A, while a color mark 203 of the same color is formed also on the lower surface of the case 200. These color marks 202 and 203 represent the color of the developing material accommodated within the developing unit A, and may be formed by application of paint or affixing of sheets. The other developing unit B and other developing units for replacement are also formed with such color marks on the same positions. As illustrated in FIG. 7, in the developing unit B, the color mark 202' corresponding to the color mark 202 of the developing unit A is located at the lower side, while the color mark 203' corresponding to the color mark 203 of the developing unit A is located at the upper side.

On the other hand, in the open/close plate 90 attached to the housing 300 of the copying machine main body, a light transmitting portion or opening 301 is formed in a position corresponding to the color mark 202 of the developing unit A. Moreover, in the housing 300 at a position corresponding to the color mark 203' of the other developing unit B, another opening 302 is also formed.

By the above construction, in the state where the open/close plate 90 is closed, the positions of the developing units A and B and/or the color of the developing material of the developing unit which can be used at present, and that of the developing material of the developing unit mounted as a spare unit, may be readily found from the outer side.

(iv) Link mechanism and other constructions

Figure 4:
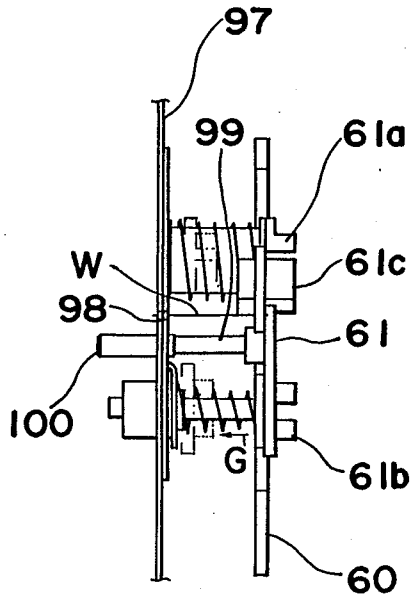
FIG. 4 is a left side view of the clockwise rotation support plate of FIG. 3.

Reference is further made to FIG. 3 showing the link mechanism and a rear side view of the clockwise rotation support plate 60, and also to FIG. 4 showing a side elevational view thereof.

The open/close plate 90 may be pivoted about an axis 91 within a range through 90° between a position indicated by solid lines and another position shown by two-dotted chain lines in FIG. 3. In an open/close plate angle member 92 attached to one side of the open/close plate 90 adjacent to the pivotal axis 91, there is formed an elongated opening 93 directed slantwise, in which one end of a connecting rod 94 is engaged. The other end of the connecting rod 94 horizontally disposed is engaged with a short piece 95*a* of an inverted L-shaped lever 95 pivotally provided about a rotary shaft 96. This short piece 95*a* is generally horizontally directed, with the long piece 95*b* of the lever 95 being directed downward. To the forward end of this long piece 95*b*, one end of a wire W is connected. The wire W horizontally directed has its other end connected to the connecting plate 61 through a hole 98 formed in the housing 97 as shown in FIG. 4, and is in a state where it is folded at right angles at the position of the hole 98.

As shown in FIG. 1, the connecting plate 61 is provided with the connecting portions 61*a* and 61*b*, and also the connector receiver 61*c*, and is displaceable in the axial direction of the developing unit as described ealier, with its axis 99 being adapted to slide within a bearing portion 100 (FIG. 4) during the displacement.

The distal end of the vertical long piece 95*b* of the lever 95 described earlier is further engaged wth the left side end portion of an L-shaped slide plate 101, which is formed with an elongated opening 101*a* at a position slightly toward the right side in a horizontal piece thereof. A rotary shaft 102 fixed at its one end to the clockwise rotation support plate 60 is extended through the elongated opening 101*a*. Furthermore, at the right side end portion of this L-shaped slide plate 101, there is formed a key portion 101*b* which is fitted in a fitting portion 105 of the arm connecting member to be described later.

The positioning arms 62*a* and 62*c* (FIG. 1) are connected by an arm connecting member 103 at the outer side of the clockwise rotation support plate 60. Meanwhile, the positioning arms 62*b* and 62*d* are also connected by another arm connecting member 104 disposed generally in a parallel relation with respect to the arm connecting member 103.

Generally at the central portion of the arm connecting member 103, there is formed the fitting portion 105 in which the key portion 101*b* of the L-shaped slide plate 101 is fitted as described earlier. Between the arm connecting members 103 and 104, springs 106 and 107 are connected at the upper and lower portions (FIG. 3).

Figure 5:
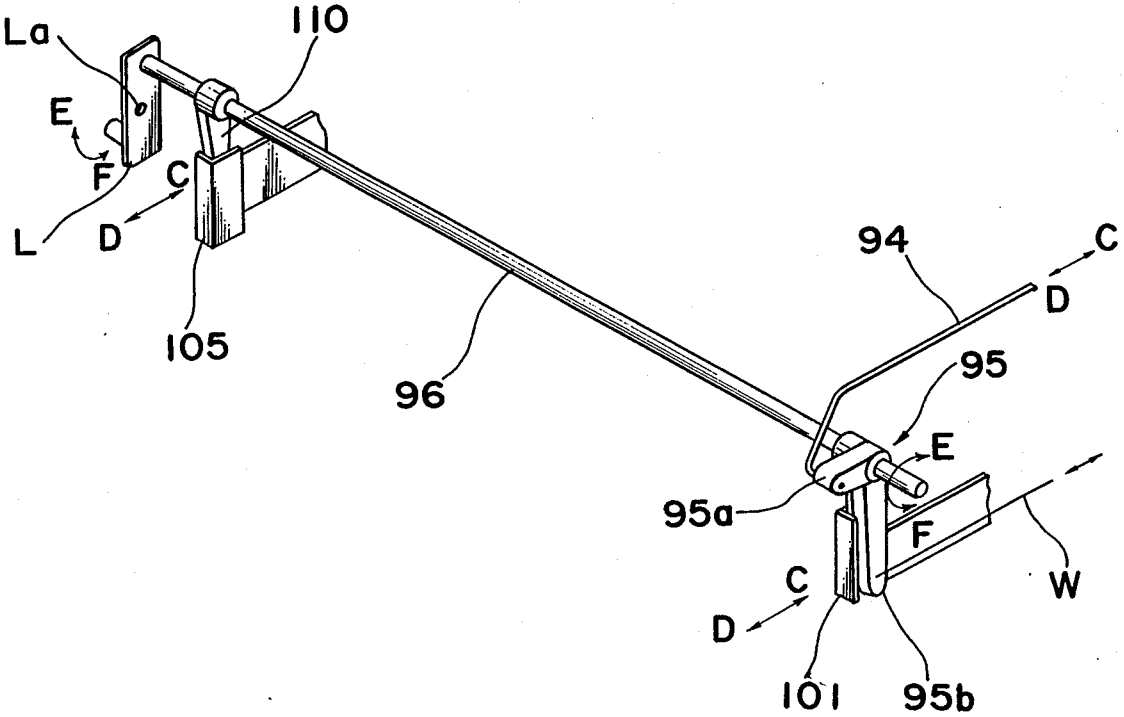
FIG. 5 is a fragmentary perspective view showing part of a link mechanism illustrated in FIGS. 3 and 4.

Referring also to FIG. 5 showing opposite end portions of the rotary shaft 96 rotatably supporting the lever 95 at its one end, another lever 110 is also mounted at the left end portion of the rotary shaft 96. The lever 110 has the shape similar to the vertical long piece 95*b* of the lever 95 provided at the right end portion of the rotary shaft 96, with the forward end of the lever 110 engaged with the L-shaped slide plate 105, which functions when the positioning arms 83*a* to 83*d* are displaced in the direction of the photoreceptor drum 1 in the counterclockwise rotation support plate 80.

Although the arm connecting members 103 and 104 as illustrated in FIG. 3 are not shown in the counterclockwise rotation support plate 80 in FIG. 1, it is to be noted that arm connecting members for connecting the upper and lower positioning arms are provided also in this support plate 80 in the similar manner as in the clockwise rotation support plate 60.

Figure 6:
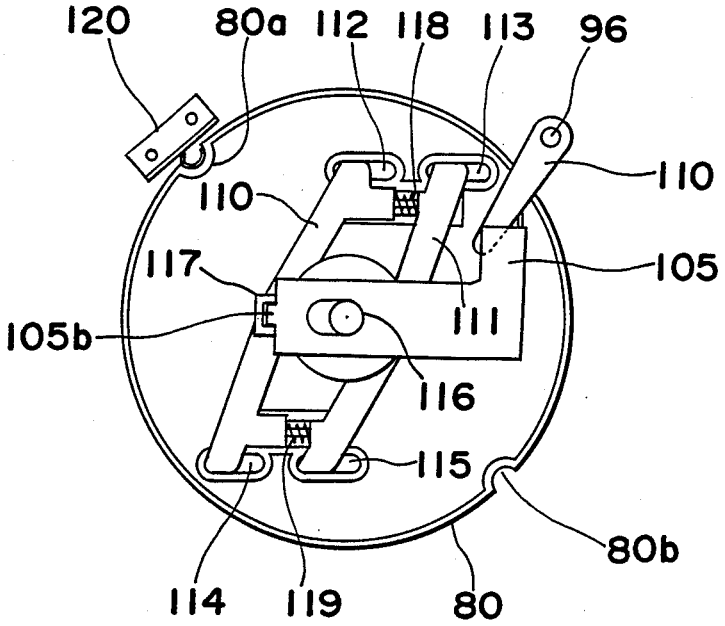
FIG. 6 is a rear side view of a counterclockwise rotation support plate employed in the arrangement of FIG. 1.

FIG. 6 shows an external view (rear side view) of the counterclockwise rotation support plate 80. In FIG. 6, there are provided arm connecting members 110 and 111 respectively corresponding to the arm connecting members 103 and 104 of the clockwise rotation support plate 60. The counterclockwise rotation support plate 80 is formed with elongated openings 112 and 113 at its upper portion, and also with elongated openings 114 and 115 at its lower portion, and has a rotary shaft 116 connected at its one end, to a central portion of the support plate 80. The L-shaped slide plate 105 is formed at its left end portion with the key portion 105*b*, while a fitting portion 117 for receiving the key portion 105*b* is provided generally at the central portion of the arm connecting member 110. Between the arm connecting members 110 and 111, springs 118 and 119 are connected at the upper and lower portions. The arm connecting member 110 connects the positioning arm 83*a* with the positioning arm 83*c* (not shown, and provided in a position confronting the positioning arm 62*c*) through the elongated openings 112 and 114. Meanwhile, the arm connecting member 111 connects the positioning arm 83*b* with the positioning arm 83*d* (not shown and provided in a position confronting the positioning arm 62*d*).

As referred to earlier, the counterclockwise rotation support plate 80 generally of a disc-like configuration has the cut-out portions or notches 80*a* and 80*b* at two confronting positions of its peripheral edge, which are adapted to engage the rotation restricting elastic member 120 fixed at the side of the copying machine main body. In the state as shown in FIG. 6, the elastic member 120 is in engagement with the cut-out portion 80*a*.

In FIG. 5, at the forward end of the rotary shaft 96 for rotating the levers 95 and 110, there is mounted a positioning release lever L, which is formed with a positioning hole La at is central position, and the lever L may be rotated in the direction of the arrow E until the hole La is engaged with a convex portion (not shown). This positioning release lever L has the same function as the connecting rod 94 of the open/close plate 90. More specifically, even without opening the open/close plate 90, the wire W and slide plates 101 and 105 may be pulled forward in the direction of the arrow D by rotating the positioning release lever L in the direction of the arrow E, and thus, the connecting plate 61 is released from the connected state, while by displacing the positioning arm in the direction opposite to the photoreceptor drum 1, the engagement of the projections of the developing unit, with the engaging receiving portions 63, 67, 82, etc., can be released. Accordingly, when the above connected state and positioned state are released through rotation of the positioning release lever L, the developing unit may be rotated, with the close/open plate 90 kept closed, by rotating the rotating lever 25 (FIG. 2).

(c) Functions of developing unit exchange device (i) Exchange operation 1

The open/close plate 90 is turned to open. In this case, if the original document placing table of the copying machine main body is located above the open/close plate 90, such table should be displaced before opening the open/close plate 90. Upon opening of the open/close plate 90, the connecting rod 94 is moved in the direction of the arrow C (FIGS. 3 and 5), and the lever 95 is rotated in the direction of the arrow E (through approximately 30°). In this case, the wire W, connected at its one end to the long piece 95*b* of the lever 95 is pulled. Since the other end of the wire W is connected to the connecting plate 61 as the wire W is bent at right angles after having extended through the hole 98 of the housing 97 (FIG. 4), the connecting plate 61 is displaced in the direction of the arrow G when the wire W is pulled (FIG. 4). By the displacement of the connecting plate 61 in the direction of the arrow G, the connected state between the connection portions 61*a* and 61*b*, and the driving rollers 50 and 51 of the developing unit A located at the side of the photoreceptor drum 1 is released, and furthermore, the connector 53 and the connector receiver 60*c* are also released from the combined state.

As the lever 95 is further rotated in the direction of the arrow E, the slide plate 101 is shifted in the direction of the arrow D. Thus, the key portion 101*b* provided at the end portion of the slide plate 101 pulls the arm connecting member 103 in the direction of the arrow D, with the arm connecting member 104 being further pulled in the direction of the arrow D through the springs 106 and 107. Accordingly, the positioning arms 62 are pulled in the direction opposite to the photoreceptor drum 1, i.e., in the direction of the arrow D. Therefore, the whole developing unit is also pulled in the direction of the arrow D, and in the developing unit A, the engagement of the engaging projections 52 and 54 with respect to the engaging receiving portions 63 and 82 are released. It is to be noted here that, as shown in FIG. 5, upon opening of the open/close plate 90, since the slide plate 105 is also displaced in the direction of the arrow D together with the slide plate 101, the positioning arms 83 are pulled in the direction opposite to the photoreceptor drum 1 also at the counterclockwise rotation support plate 80. Accordingly, it becomes possible in this state to withdraw the developing unit A ouside through the opening portion 89.

(ii) Exchange operation 2

The developing unit A is taken out through the opening portion 89, and a fresh developing unit A' containing a colored developing material is inserted. In this case, the engaging projections of the fresh developing unit A' are slid along the respective guide grooves 96 and 81 of the clockwise rotation support plate 60 and counterclockwise rotation support plate 80 for the insertion. In the above case, since the fresh developing unit A' to be replaced contains the colored developing material, the engaging projection 52 (FIG. 1) is large. Due to the fact that the width of the guide groove 65, whose opened portion is directed upward, is also large, the developing unit A' may be inserted as it is. However, in the case where the opened portion of the guide groove 66 is directed upward, the engaging projection 52 can not be fitted thereinto, because the groove is small in its width. In other words, the developing unit containing the colored developing material may be mounted only at the upper portion of the developing apparatus main body.

(ii)-(a) Stopper function in exchange operation 2

Upon withdrawal of the developing unit A, the center of gravity of the whole developing apparatus is shifted, thereby resulting in loss of balance. In this case, however, since the rotation restricting elastic member 120 is engaged with the notch 80*a*, there is no possibility that the developing unit B will be undesirably rotated. In other words, the developing unit B is prevented from rotation by the stopper action of the elastic member 102. Accordingly, any injury to the operator through rotation of the developing unit B due to the lost balance may be advantageously prevented, while owing to the fact that the opened portion of the guide groove 65 is held in the upwardly directed state, mounting of the developing unit A' may be readily effected.

(iii) Exchange operation 3

After insertion of the fresh developing unit A', the open/close plate 90 is closed. Then, by the action contrary to the above, the connecting plate 61 is brought into the connected state, and the positioning arms 62 and 83 are displaced in the direction of the photoreceptor drum 1 to establish the mounted state of the unit, and thus, the positioning of the fresh developing unit A' is completed.

(iv) Change-over of developing units

For changing-over the developing units, the positioning release lever L (FIG. 5) is rotated in the direction of the arrow E until the positioning hole La thereof is locked by the convex portion (not shown), with the open/close plate 90 being kept closed. In this case, since the rotary shaft 96 also rotates in the same direction E, the wire W and the slide plates 101 and 105 are pulled in the direction of the arrow D. By these functions, the connected state by the connecting plate 61 is released in the similar manner as in the case where the open/close plate 90 is opened. At this time, the connecting plate 61 is displaced to the position indicated by the two-dotted chain lines as shown in FIG. 4, so as not to obstruct rotation of the clockwise rotation support plate 60, thus bringing the plate 60 in the freely rotatable state. Meanwhile, since the positioning arms 62 and 83 are also displaced in the direction opposite to the photoreceptor drum 1, i.e, in the direction of the arrow D, the positioned state is released. In this case, if the rotary shaft 0 is rotated by the rotary lever 25 (FIG. 2), the clockwise rotation support plate 60 and counterclockwise rotation support plate 80 are rotated, with consequent rotation of the two developing units. When the rotation is stopped at the position where the rotation restricting elastic member 120 is engaged with the notch 80*b*, the developing unit B reaches the position confronting the photoreceptor drum 1 instead of the developing unit A. In this state, the positioning release lever L is rotated in the direction of the arrow F to be returned to the original position. Then, the connecting plate 61 is brought into the connected state with respect to the developing unit B, while the positioning arms 62 and 83 are displaced to the side of the photoreceptor drum 1, i.e., in the direciton of the arrow C to establish the positioning state.

By the above function, the developing units may be readily exchanged by merely opening the open/close plate 90, while any desired developing unit of the two developing units within the developing apparatus can be positioned at the side of the photoreceptor drum. During exchange of the developing units, rotation of the entire developing apparatus may be prevented by the action of the rotation restricting elastic member 120.

In the above case, since the open/close plate 90 is located immediately above the rotary type developing apparatus, exchange work of the developing units is remarkably facilitated. Furthermore, the color of the developing material which can be used at present and that of the developing unit mounted as a spare unit may be positively ensured from the outside at all times without necessity for particularly opening the open/close plate 90.

Moreover, according to the arrangement of the present invention as described so far, the developing unit for the colored developing material is rotated only at the upper half of the developing apparatus, while the developing unit for the non-colored developing material is rotated only at the lower half thereof, the non-colored developing material mainly adheres to the receiving pan 27, with adhesion of the colored developing material thereto being limited to a very small amount. Furthermore, by the different sizes of the engaging projections 52 (52') and 54 (54'), and the guide grooves 64, 65 and 81, the developing unit for the colored developing material can be mounted only at the upper side of the apparatus, and therefore, there is no possibility that a large amount of colored developing material adheres to the interior of the receiving pan 27, and therefore that the image quality is deteriorated by the mixing of a small amount of the non-colored developing material in the large amount of the colored developing material.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A rotary type developing apparatus for use in an image forming arrangement, which comprises a first developing unit (A) accommodating therein a colored developer material, and a second developing unit (B)

accommodating therein a non-colored developer material excluding a white group developer material, said first and second developing units (A, B) being respectively exchangeably disposed beside a photoreceptor drum (1), rotatably supported so as to selectively cause one of said developing units (A, B) to confront said photoreceptor drum (1), and a receiving pan (27) provided below said developing units (A, B) for receiving the developer material scattering therefrom, the improvement comprising a rotation restricting means (26) for restricting a rotational range of said first developing unit (A) to an upper half, and that of said second developing unit (B) to a lower half, and a mounting position limiting means for enabling said first developing unit (A) to be mounted only at the upper side of a main body of said developing apparatus (4).

2. A rotary type developing apparatus for use in an image forming arrangement, which comprises a plurality of developing units (A, B) disposed beside a photoreceptor drum (1), rotatably supported so as to selectively cause one of said developing units (A, B) to confront the photoreceptor drum (1), with the respective developing units (A, B) being mounted to be exchangeable, color marks (202, 203) affixed on a surface of a casing (200, 201) of each of said developing units (A, B) for indicating color of the developer material accommodated in each of said developing units, and light transmitting portions (301, 302) provided on a main body of said image forming arrangement in positions confronting said color marks affixed on said developing units.

3. A developing unit exchanging device for a rotary type developing apparatus for use in an image forming arrangement, which comprises a plurality of developing units (A, B) disposed beside a photoreceptor drum (1), rotatably supported so as to selectively cause one of said developing units (A, B) to confront the photoreceptor drum (1), connectable roller driving portions (50, 51) and engaging portions (52, 54) provided beside said developing units (A, B), and open/close plate (90) provided in a position immediately above the rotary type developing apparatus in a housing of the image forming arrangement accommodating said developing apapratus, a connecting plate (61) connectable with the roller driving portions (50, 51) of the developing unit located at the side of the photoreceptor drum (1), of the plurality of said developing units (A, B), and movable in the axial direction of the developing unit, a developing unit positioning means movable in the direction of the photoreceptor drum (1) and adapted to effect positioning of the developing unit during the movement in the direction of said photoreceptor drum, engaging receiving portions (63, 67, 82) engageable with said engaging portions (52, 54) of the plurality of said developing units (A, B) upon positioning by said developing unit positioning means, and a link mechanism which connects said open/close plate (90), said connecting plate (61) and said developing unit positioning means, and is so arrnged to move the connecting plate (61) in the direction for connection with said roller driving portions (50, 51) to bring them into a connected state upon closure of said open/close plate (90) and also, to displace said developing unit positioning means in the direction of the photoreceptor drum (1) for positioning of the developing unit, and further, to set the developing unit in a detachable state by releasing said connected state and said positioned state upon opening of said open/close plate (90).

* * * * *